US009433299B2

(12) United States Patent
Abelmann et al.

(10) Patent No.: US 9,433,299 B2
(45) Date of Patent: Sep. 6, 2016

(54) WALL BENCH

(71) Applicants: Charles Abelmann, Silver Spring, MD (US); Daniel Umscheid, Weatherby Lake, MO (US)

(72) Inventors: Charles Abelmann, Silver Spring, MD (US); Daniel Umscheid, Weatherby Lake, MO (US)

(73) Assignee: Barrie School, Silver Spring, MD (US)

( * ) Notice: Subject to any disclaimer, the term of this patent is extended or adjusted under 35 U.S.C. 154(b) by 246 days.

(21) Appl. No.: 13/999,854

(22) Filed: Mar. 28, 2014

(65) Prior Publication Data

US 2015/0272336 A1 Oct. 1, 2015

(51) Int. Cl.
*A47C 11/00* (2006.01)
*A47C 7/62* (2006.01)

(52) U.S. Cl.
CPC *A47C 11/00* (2013.01); *A47C 7/62* (2013.01)

(58) Field of Classification Search
CPC ..... A47C 11/00; A47C 7/62
USPC ..... 297/188.04, 188.07; 312/235.7
See application file for complete search history.

(56) References Cited

U.S. PATENT DOCUMENTS

| | | | | | |
|---|---|---|---|---|---|
| 948,238 | A * | 2/1910 | Mulford | A47B 81/00 | 312/235.7 X |
| 1,231,303 | A * | 6/1917 | Seligman | A47C 7/70 | 297/188.07 |
| 1,639,085 | A * | 8/1927 | Fohey | G09F 23/00 | 297/188.04 |
| 3,254,931 | A * | 6/1966 | Jacobi | A47C 11/02 | 297/163 |
| 8,398,183 | B2 * | 3/2013 | Cheung | A47B 83/00 | 248/303 X |
| 2003/0107247 | A1 * | 6/2003 | Wills | A47C 7/70 | 297/188.1 X |

* cited by examiner

*Primary Examiner* — Anthony D Barfield
(74) *Attorney, Agent, or Firm* — Jonathan E. Grant; Grant Patent Services

(57) ABSTRACT

A wall bench for use in a school building is disclosed. The wall bench is comprised of a platform and a vertical support. In front of the vertical support is a bench and a backing positioned angularly that supports a black board, white board, or electronic screen. Beneath the bench is storage space. Behind the vertical support is additional storage space.

6 Claims, 10 Drawing Sheets

WALL BENCH

BACKGROUND OF THE DISCLOSURE

Over the years, most schools have used the traditional table and chair arrangement in the classroom. Students sat in a chair, with a desk in front of them, sometimes two to a chair, all facing towards a chalk board.

However, as the student body has changed, and as the needs of the students and society have changed, new less traditional approaches to education are needed. These approaches include changes to the curriculum, to the method of learning, to the school building, and even to the furniture in the classroom.

SUMMARY OF THE DISCLOSURE

The present disclosure is for an efficient school wall bench. The wall bench maximizes the efficiency of space it occupies in a classroom, while allowing for modern learning.

In one embodiment of the disclosure, the wall bench comprises storage space beneath the seats.

In another embodiment of the disclosure, the wall bench comprises a backboard.

In another embodiment of the disclosure, the back of the bench comprises a blackboard.

In another embodiment of the disclosure, the back of the bench comprises a whiteboard.

In another embodiment of the disclosure, the back of the bench comprises an electronic screen.

In another embodiment of the disclosure, the space under the seat has a divider.

In yet another embodiment of the disclosure, there is storage space on backside of the wall bench.

In yet another embodiment of the disclosure, the storage space are cubbyholes.

Another embodiment of the disclosure allows for wheels on the underside of the wall bench

Figure 1:
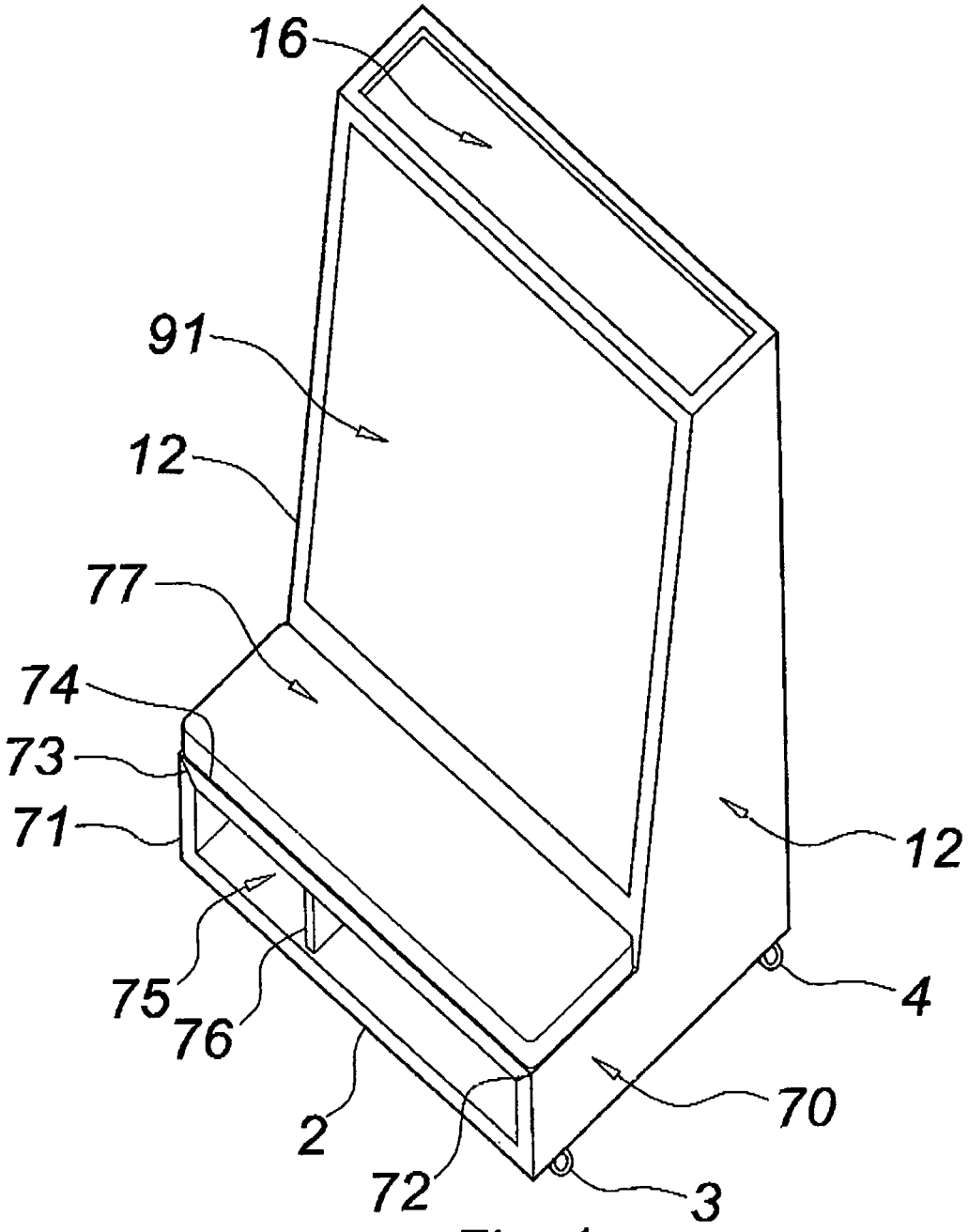
FIG. 1 is a perspective front view of the wall bench.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DISCLOSURE

Figure 2:
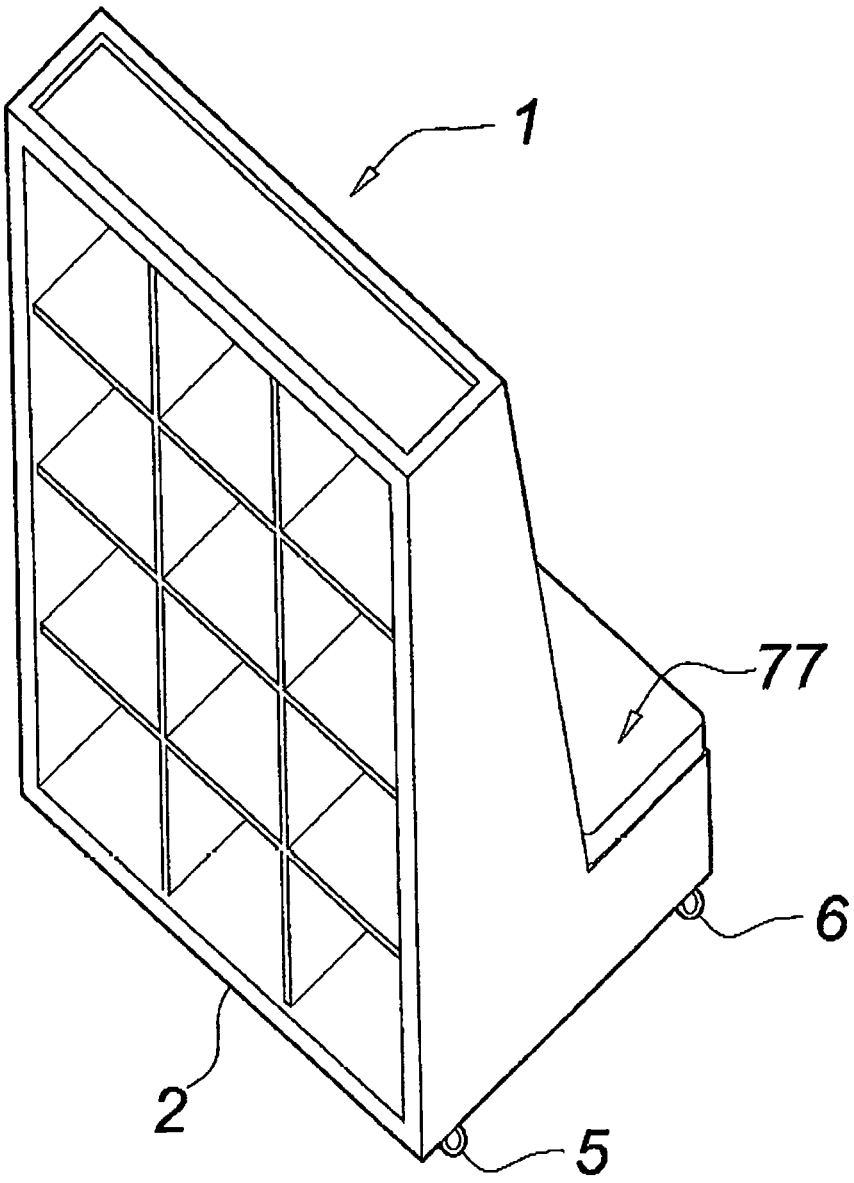
FIG. 2 is a perspective back view of the wall bench.
Figure 3:
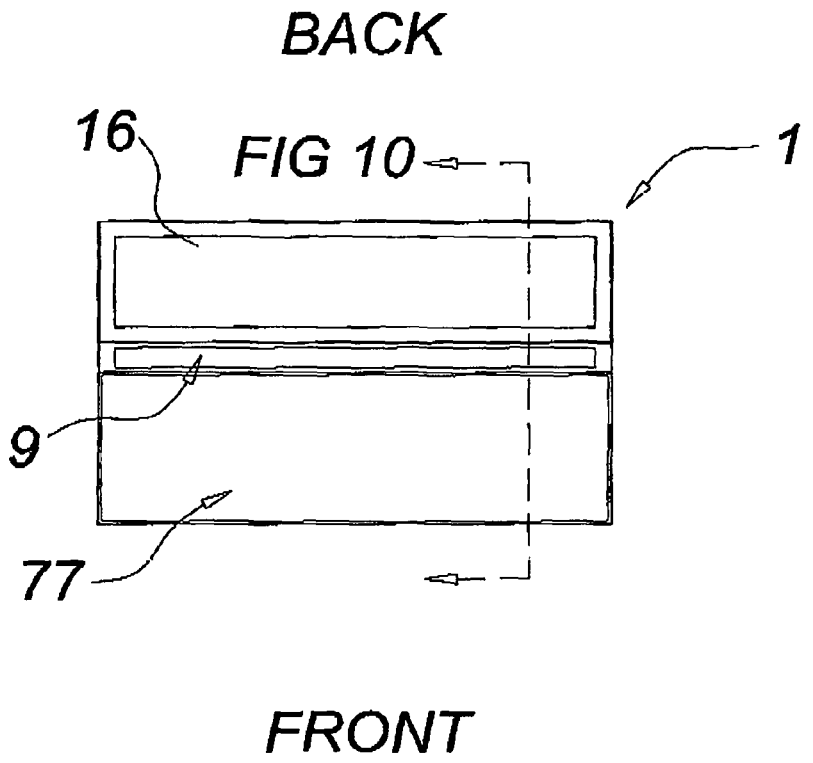
FIG. 3 is a top view of the wall bench.
Figure 4:
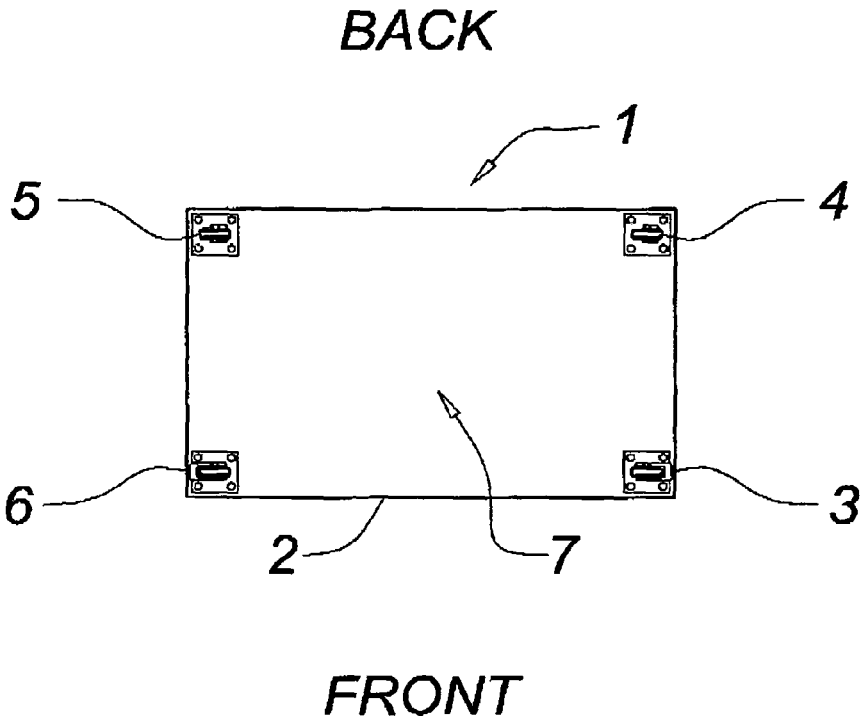
FIG. 4 is a bottom view of the wall bench.
Figure 5:
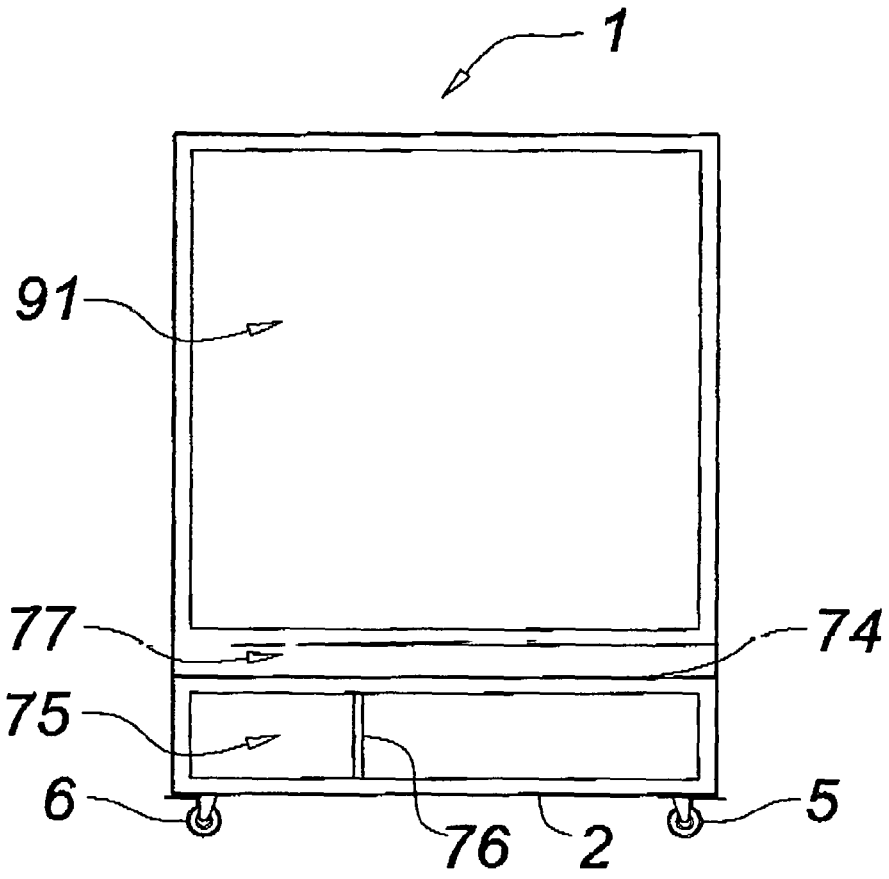
FIG. 5 is a front view of the wall bench.
Figure 6:
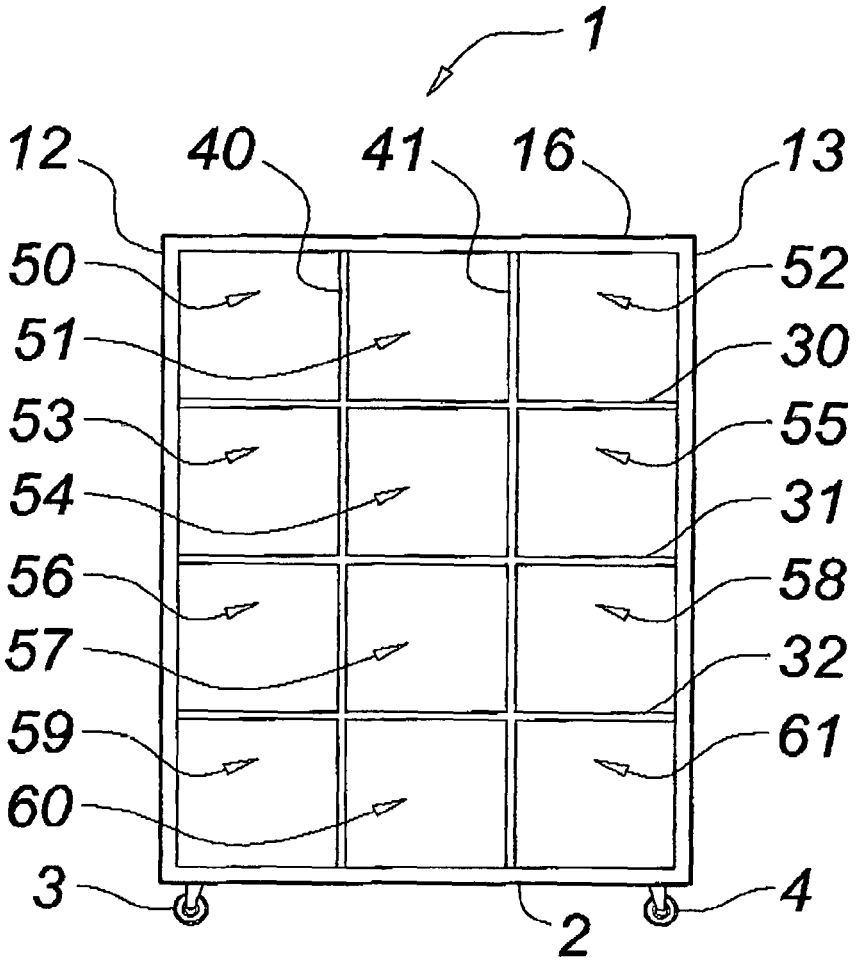
FIG. 6 is a back view of the wall bench.
Figure 7:
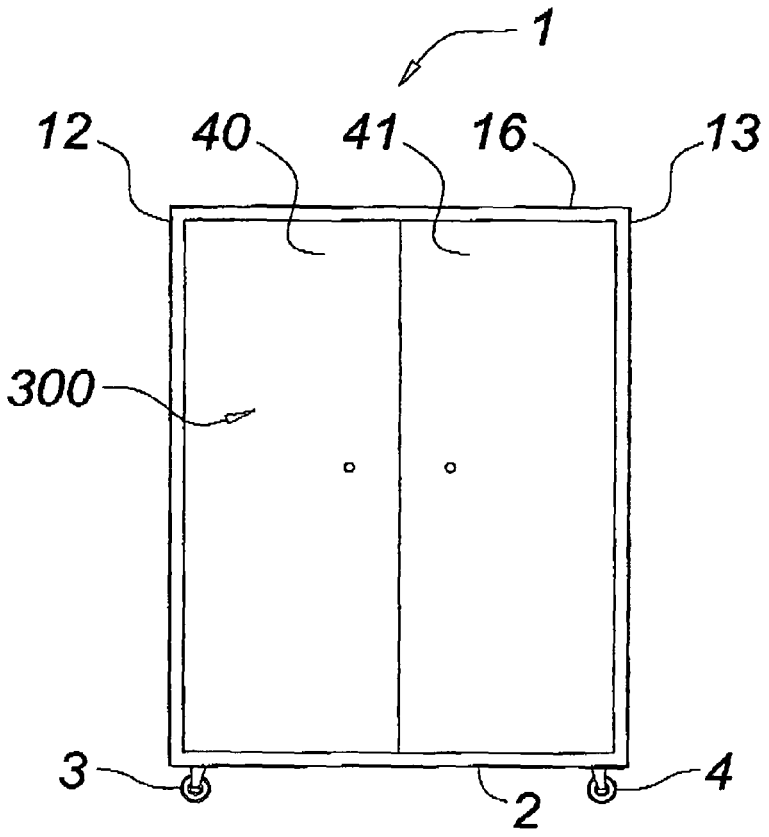
FIG. 7 is a back view of an alternative embodiment of the wall bench.
Figure 8:
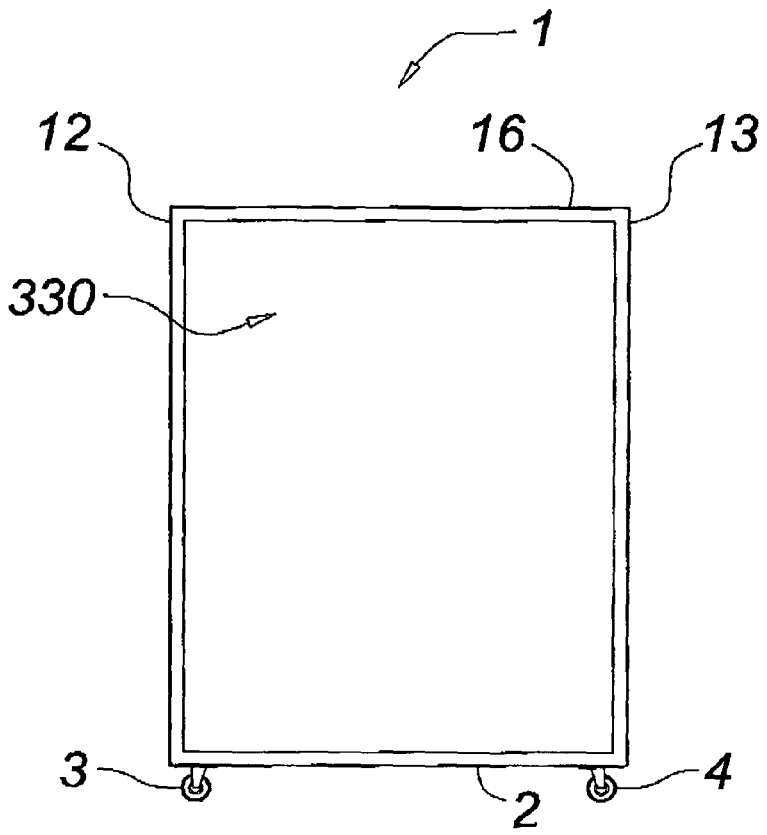
FIG. 8 is a back view of an alternative embodiment of the wall bench.
Figure 9:
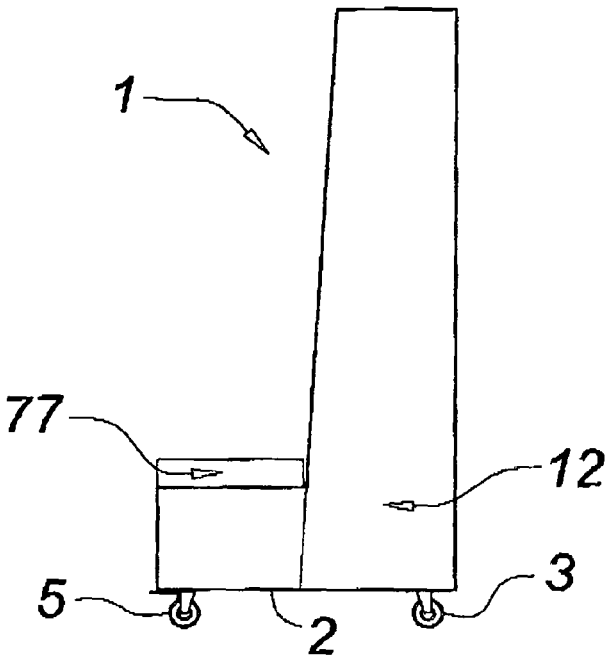
FIG. 9 is a side view of the wall bench.
Figure 10:
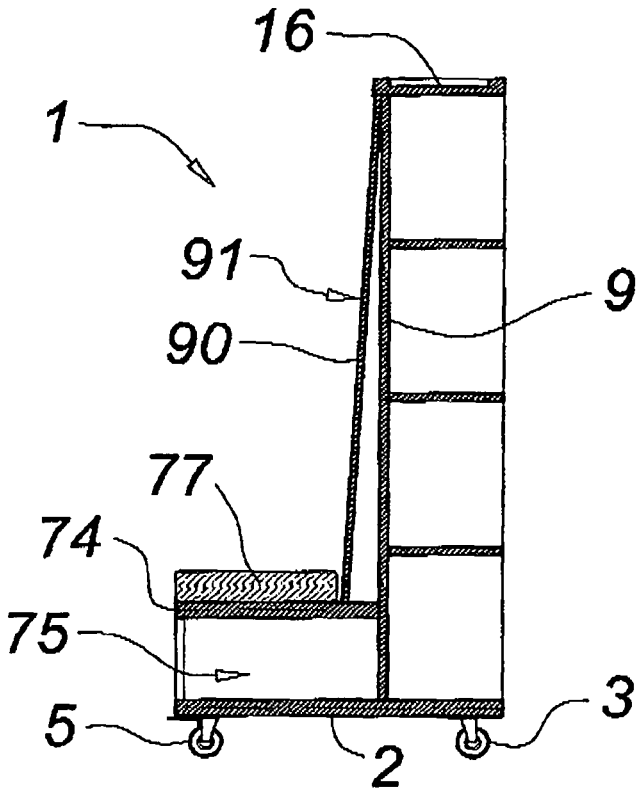
FIG. 10 is a cutway side view of the wall bench.

Referring to FIGS. 1-8, the wall bench 1 comprises a platform 2 upon which the superstructure will rest. At least three wheels, and preferably four wheels 3, 4, 5, 6, are positioned on the underside 7 of the platform 2. In one embodiment, locking caster with wheels are used. The platform 2 is rectangular in shape and is approximately about 2½ feet to about 3/12 feet wide and about 4 feet to about 7 feet long, although these dimensions can vary. The platform 2 must be strong enough to support a heavy superstructure as, in different embodiments, the platform is one thick sturdy board or two or more boards glued or screwed together. The thickness of the platform can range from ½" thick to 1½" thick or more. On the top side 8 of the platform 2 is a vertical support 9 that is positioned perpendicular to the platform, runs the length of the platform and is from about 4 to about 6 feet tall. The rectangular shaped vertical support 9 is positioned off center from the middle of the platform 2 such that the front side 10 of the platform is from about 60 to about 75 percent of the platform, and the back side 11 of the platform is from about 25 to about 40 percent of the platform.

Side panels 12 and 13 are parallel to each other, and are attached to each end 100 101 of the rectangular shaped vertical support 9 and to (width) ends 80, 81 of the platform. In another embodiment, the side panels 12, 13 are not attached to the ends of the vertical support 9 but are instead attached to the back side 102 of the vertical support 9. Top panel 16 is rectangularly shaped, and has ends 14, 15 attached at the top ends 17, 18 of the side panels. The top panel extends along length of the vertical support and has a width measured from the back edge of the platform to about an inch past the front edge 19 of the vertical support 9. The top panel 16 is also affixed to the top of the vertical support. In another embodiment, the width of the top panel ends at the front edge of the vertical support 9.

Between the two side panels 12, 13 and between the top panel 16 and the platform 2 are cubby holes 50, 51, 52, 53, 54, 55, 56, 57, 58, 59, 60, 61 formed by lateral boards 30, 31, and 32 extending between side panels 12 and 13 and/or longitudinal boards 40 and 41 extended between the top panel 16 and the platform 2, with respective cutouts for intersecting joints in the boards. Inversely there are two lateral pieces and three longitudinal pieces. The cubby holes are formed by any known means, including individual wooden sections, cutouts in either the longitudinal or lateral pieces, or any other method known in carpentry. In another embodiment, there are more or less cubby holes, depending on the number of lateral and longitudinal sections forming the cubby holes. The longitudinal and lateral boards are to connected to each other and to the sides of the structure by nails, glue, brackets, or any other methods known in the field of carpentry.

In front of and perpendicular to the vertical support 9 and on top of the platform 2 are two bench supports 70, 71 positioned on the edge of each width end 80, 81 of the platform. These bench supports 70, 71 are from about 10" to about two feet tall. In another embodiment, the bench support is 1½ feet high and about 12" to 18" long. In one embodiment, the length of the bench supports 70, 71 are 15". In one embodiment, the bench supports are comprised of two pieces of wood 114, 115 secured together. In another embodiment, the bench support is an extension of the side panels 12 13. In another embodiment of the disclosure, the side panels 12, 13 comprise the outer layers 115 of the bench supports. In one embodiment, the top ends 72, 73 of the bench supports 70, 71 are inwardly angularly cut. In one embodiment, virtually all of the boards on top of the platform 2 in contact with or supporting other boards are angularly cut or are dove tailed at the intersection with other boards.

On top of and supported by the bench supports 70, 71 is bench rest 74, thus forming a space 75 enclosed on five sides. This space allows for additional storage of school books, school supplies, etc. A divider 76 is positioned between the bench supports 70 and 71 and between the bench rest 74 and the platform 2, and underneath the bench rest 74. In one embodiment the divider 76 is centered between the bench supports 70 and 71. In another embodiment the divider is off center. The bench rest 74 needs to support the weight of at least one or two students, hence, in one embodiment, the bench rest 74 is comprised of two pieces of wood secured together for added strength.

In one embodiment, a cushion 77 is positioned on top of the bench rest 74. The cushion 77 is not positioned up against the vertical support but is anywhere from ½" to about 2" or more from the vertical support 9. At an angle varying from 0 degrees to 15 degrees or more, an image support board 90 is positioned from the top of the vertical support 9 to the bench rest 74 behind the cushion 77, and is attached by any methodology known in the art. In one embodiment, the image support board is positioned underneath and in contact with the leading edge of the top panel 16.

The space between the image support board 90 and the vertical support 9 on each side of the structure is covered by side panels 12, 13. In another embodiment, the space between the image support board 90 and the vertical support 9 has a filler piece.

On the surface of the image support board 90 is a display board 91, such as a white board, a blackboard, or an electronic display screen for a computer or other electronic device. This display board can be of any size that fits within the dimensions of the image support board. If the device is an electronic display board, the display board can be wired to a computer or other piece of equipment, or it can be operated by a wireless connection.

Given the size of the device several wall benches can be put together to form separate classes or teaching units in the same room. The furniture acts as a wall (hence the name "wall bench." This gives the instructor and the school greater flexibility in organizing study groups, separating students based on ability or project being worked on, or allows an instructor greater board space in a room.

With the exception of the display board and the cushion, part of or the entire surface of the wall bench can be covered in a wood veneer to give a more finished look. In another embodiment of the structure, the wall bench can be made out of a hard plastic, such as polyvinylchloride.

It should be noted that any strong material or combinations can be used to secure the sections of the wall bench together, by means well known in the carpentry field. These methods include dovetail cuts, angular cuts, nails, screws, wood glues, etc.

Other embodiments can be included for the convenience of the user. In one embodiment, the storage space 75 under the seating area can have doors allowing the stored materials under the seat to be kept out of sight.

The storage area behind the vertical support can also be kept hidden by latched doors 300, with the hinges attached to the side panels. In yet another embodiment, the storage area does not have cubby holes. In another embodiment, hooks 330 can be installed in the back of the vertical support 9 so that students can hang up their coats and jackets.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A portable school wall bench, said bench comprising:

a) a platform having underside; and b) a superstructure on said platform, said superstructure comprising:

I) a vertical support having a front side and a back side, said vertical support connected perpendicularly to and running the length of said platform;

II) a front section positioned in front of said vertical support on said platform, said front section comprising:

A) a first vertical bench support positioned at a width edge of and perpendicular to said platform and positioned perpendicularly to a first edge of said vertical support;

B) a second vertical bench support positioned on a second width edge of and perpendicular to said platform and positioned perpendicularly to a second edge of said vertical support;

C) a bench supported by said first bench support and said second bench support;

D) an display support board, wherein a top of the display support board is positioned from near the top of the vertical support and a bottom of the display support board is positioned on the bench, said display, support board being positioned at an angle having a range from about 0 degrees to about 22.5 degrees, the ratio of the display support board to the bench ranging from about 4.8 to about 7.2;

E) a storage section, said storage section bounded by said first vertical bench support, said second vertical bench support, said platform, said vertical, support, and said bench, wherein said storage section is open at the front;

F) a display board on top of said display support board wherein said display play board is selected from the group consisting of blackboards, whiteboards and electronic display board; and III) a back section, said back section comprising:

a) a first side panel, said first side panel positioned along the first width edge of the platform with one lengthwise edge of the first side panel positioned against the first edge of the vertical support;

b) a second side panel, said second side panel positioned along the second width edge of the platform with one lengthwise edge of the second side panel positioned against the second edge of the vertical support;

c) a top panel said top panel positioned on top of or at the top between said first side panel and said second side panel, wherein a storage space is formed in the back section.

2. The portable school wall bench according to claim 1, further comprising cubby holes in the storage area.

3. The portable school wall bench according to claim 1, further comprising hooks on the back of the vertical support.

4. The portable school wall bench according to claim 1, further comprising doors positioned over the storage space, said doors hinged to said first side.

5. The portable school wall bench according to claim 1, further comprising a cushion over said bench rest.

6. The portable school wall bench according to claim 1, further comprising a divider between the first bench support and the second bench support and under the bench rest.

* * * * *